United States Patent [19]

Terhorst et al.

[11] 4,449,859

[45] May 22, 1984

[54] MINERAL MINING INSTALLATION

[75] Inventors: Günter Terhorst, Dülmen; Karl-Heinz Plester, Lunen; Harry Rosenberg, Ludinghausen; Friedrich Eggenstein, Bergkamen-Oberaden, all of Fed. Rep. of Germany

[73] Assignee: Gewerkschaft Eisenhutte Westfalia, Lunen, Fed. Rep. of Germany

[21] Appl. No.: 384,877

[22] Filed: Jun. 4, 1982

[30] Foreign Application Priority Data

Jun. 10, 1981 [DE] Fed. Rep. of Germany ..... 3122952

[51] Int. Cl.[3] ..... E21D 15/00

[52] U.S. Cl. ..... 405/291; 299/32; 405/290

[58] Field of Search ..... 405/291, 294, 295, 296, 405/299, 300; 299/31, 32

[56] References Cited

U.S. PATENT DOCUMENTS 4,169,689 10/1979 Weirich et al. ..... 405/291

4,227,833 10/1980 Plester et al. ..... 405/291 X

*Primary Examiner*—Dennis L. Taylor

*Attorney, Agent, or Firm*—Thompson, Birch

[57] ABSTRACT

A mineral mining installation includes a longwall conveyor and a plurality of roof support units positioned side-by-side on the goaf side of the conveyor. The conveyor is braced longitudinally by a block bracing system having a plurality of hydraulic bracing rams each of which is disposed at an acute angle to the conveyor. The bracing rams act between the conveyor and floor girders of the roof support units. Each bracing ram is attached to a respective floor girder by means of a bracket. Each bracket has first and second bracket parts welded together, the first bracket part comprising means for connecting the bracket to its floor girder, and the second bracket part forming an extension of the first bracket part and carrying a pivot joint member for pivotally supporting the cylinder of the associated bracing ram. The first bracket part is a standard cast member, to which second bracket parts of differing lengths can be welded.

10 Claims, 3 Drawing Figures

11
12
15
13
18
17
20
19
16
24
34
25
26
42
37
22
23
27
14

MINERAL MINING INSTALLATION

BACKGROUND OF THE INVENTION

The invention relates to a mineral mining installation having a longwall structure, such as a conveyor or a winning installation, and a roof support assembly constituted by a plurality of side-by-side roof support units, at least some of which are provided with hydraulic bracing rams for bracing longwall structure longitudinally.

In installations of this type, it is known to use a so-called block bracing system (block anchorage) for bracing the longwall structure longitudinally. The block bracing system comprises a relatively large number of hydraulic bracing rams, each of which is pivotally mounted between the longwall structure and the floor sill of one of the roof support units. The bracing rams are provided at the two ends of the installation, and are inclined at small acute angles to the longitudinal axis of the longwall structure. The floor sills are provided with brackets for the connection of the bracing rams.

During mining operations, it may be necessary to alter the distance between one or more of the roof support units and the longwall structure, for example to enable the roof bars of the roof support units to be advanced as closely as possible to the face being won. This is particularly important where the face slopes. Any such change in the position of a roof support unit inevitably results in a change in the angle of inclination of the associated bracing ram. This in turn results in a variation of the bracing forces applied to the longwall structure, which is undesirable. In particular, the bracing force decreases as the inclination of the rams increases with an increase in the distance between the longwall structure and the roof support units. This disadvantage can be overcome by adapting the points at which the bracing rams are attached to their floor sills to the changing operating conditions. One way of accomplishing this is to change the connecting brackets. Obviously, the changing of the brackets is time consuming, and requires a relatively large number of standard parts to be kept in stock.

U.S. Pat. No. 4,227,833 describes a mineral mining installation having bracing rams which are connected to the floor sills of the roof support units by brackets which are slidably mounted on the floor sills. The brackets can be moved towards, and away from, the longwall structure, and means are provided for securing the brackets to the floor sills in any one of a plurality of positions. Unfortunately, the use of slidable brackets results in a complicated design, and modifications to the floor sills of the roof support units. Consequently, such an arrangement results in considerably expense. Moreover, slidable attachment of the brackets to the floor sills can impede the movement of personnel along the longwall in an unacceptable manner.

The object of the invention is to provide connection means for such bracing rams which can be produced economically, even in different sizes, and which involves no troublesome expensive design steps as regards attachment to the floor sills of the associated roof support units.

Another object of the invention is to provide connection means that can be attached in a simple and rapid manner to the floor sills of associated roof support units, without materially increasing the height of those floor sills, whereby movement of personnel along the longwall is not impeded in an unacceptable manner.

SUMMARY OF THE INVENTION

The present invention provides a mineral mining installation including a longwall structure and a roof support unit, the roof support unit being provided with a substantially horizontal hydraulic bracing ram disposed at an acute angle to the longwall structure and acting on said structure to brace said structure longitudinally, the bracing ram being attached to a floor sill of the roof support unit by a bracket, the bracket having connection means for connecting the bracket to the floor sill and a pivot joint member for connection to the bracing ram, the improvement comprising forming the bracket by first and second bracket parts, the second bracket part being rigidly connected to the first bracket part, the first bracket part comprising said connection means, and the second bracket part forming an extension of the first bracket part and carrying the pivot joint member.

The invention also provides a bracket for connecting to a hydraulic bracing ram of a block bracing system of a longwall mineral mining installation, the bracket having connection means for connecting the bracket to a floor girder of a roof support unit associated with the mineral mining installation, and a pivot joint member for connection to the bracing ram, wherein the bracket comprises first and second bracket parts, the second bracket part being rigidly connected to the first bracket part, the first bracket part comprising said connection means, and the second bracket part forming an extension of the first bracket part and carrying the pivot joint member.

Advantageously, the first bracket part is a cast member, and the second bracket part comprises a head piece and the pivot joint member, the head piece being rigidly connected to the first bracket part. Preferably, the pivot joint member is provided with a plug which engages in an aperture formed in the head piece, and wherein a U-shaped locking member is provided for holding the plug within the aperture.

The second bracket part may be welded to the first bracket part. Advantageously, the first bracket part includes a claw which is engageable with the free end of said floor girder. In this case, the second bracket part may be welded to the claw of the first bracket part.

Preferably, the first bracket part is of plate-like construction, and carries the claw at one end thereof, and wherein the first bracket part is formed with an apertured boss adjacent to the claw, the apertured boss receiving a coupling pin which is engageable in an aperture in said floor girder. Conveniently, the first bracket part is provided with a connection device adjacent to the end remote from the claw, the connection device, the claw and the apertured boss comprising said connection means. Advantageously, the connection device comprises an aperture formed in the first bracket part and bolt means for connecting the first bracket part to said floor girder. The bolt means may be a hammerhead bolt.

BRIEF DESCRIPTION OF THE DRAWINGS

A preferred embodiment of the invention will now be described, by way of example, with reference to the accompanying drawings, in which.

DESCRIPTION OF PREFERRED EMBODIMENT

Figure 1:
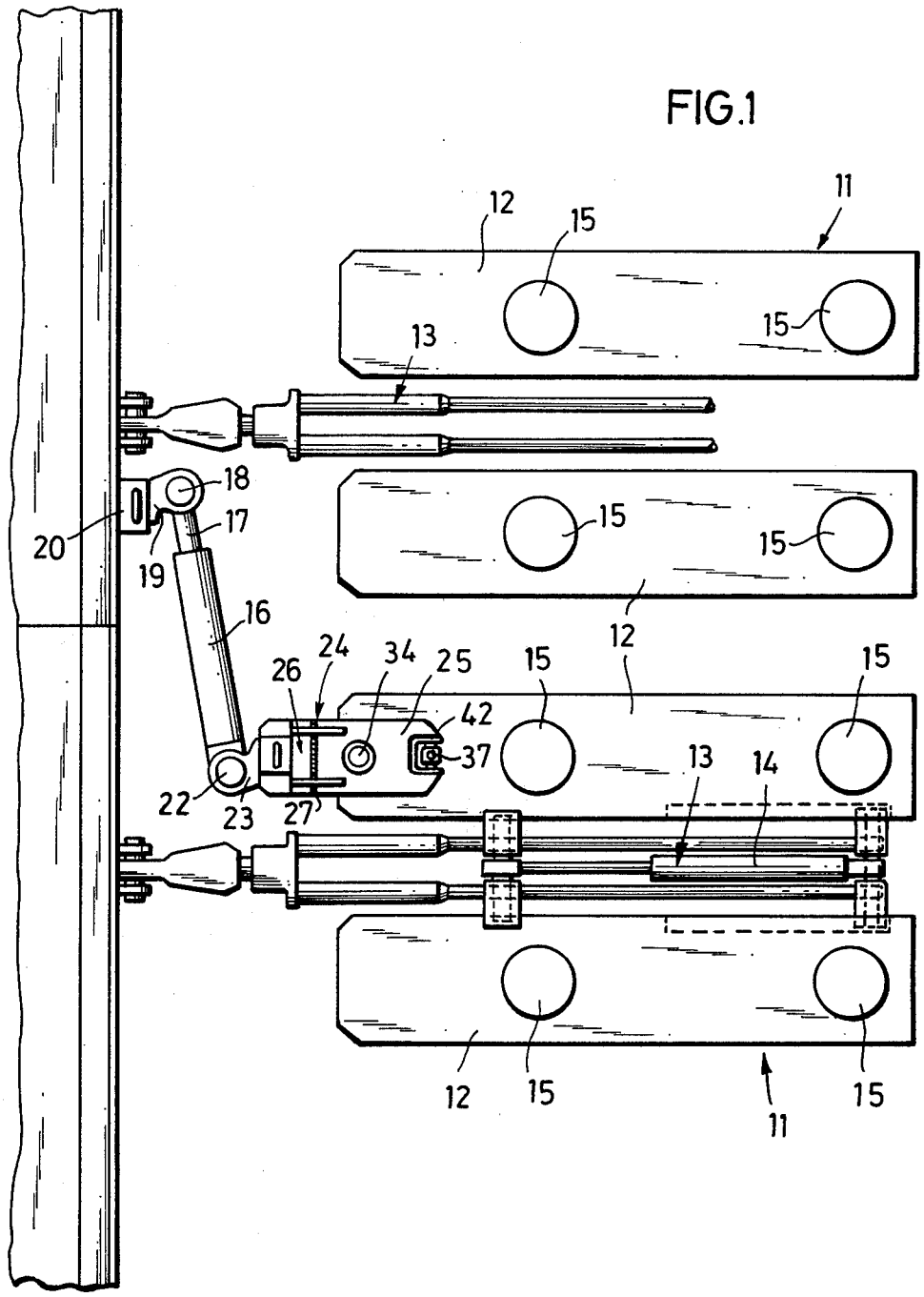
FIG. 1 is a diagrammatic plan view of part of a mineral mining installation incorporating hydraulic bracing ram connection means constructed in accordance with the invention.

Referring to the drawings, FIG. 1 shows part of a longwall mineral mining installation having a scraper-chain conveyor 10 provided with a guide (not shown) for a coal-winnning machine (not shown) such as a plough or a shearer. A mine roof support assembly, which is constituted by a plurality of roof support units 11 positioned side-by-side, is provided at the goaf side of the conveyor 10. The roof support units 11 can be advanced, either singularly or in groups, by means of advance mechanisms 13 to follow up the advance of the face and the conveyor 10. Each of the roof support units 11 (only two of which can be seen in FIG. 1) has a floor sill constituted by a pair of laterally-spaced floor girders 12. The advance mechanism 13 of each roof support unit 11 includes a hydraulic advance ram 14, and is positioned between the two floor girders 12 of that unit. The floor girders 12 of each roof support unit 11 support a roof bar (not shown) by means of hydraulic props 15. Each of the props 15 is supported on its floor girder 12 by means of a respective articulated foot joint (not shown).

In order to brace the conveyor 10 in its longitudinal direction, a so-called block bracing system is provided. The block bracing system comprises a relatively large number of hydraulic bracing rams 16, each of which is fitted between one floor girder 12 of a respective roof support unit 11 and the conveyor 10. FIG. 1 shows only one of the bracing rams 16. Each bracing ram 16 takes up both tensile and compressive forces. The piston rod 17 of each ram is pivotally connected to the conveyor 10 by means of a pivot pin 18, a connector 19, and a bracket 20. The pivot pin 18 is pivotally mounted within the connector 19 about a vertical axis, and the connector 19 is pivotally attached to the bracket 20 by means of a pivot plug (not shown) whose axis extends in the direction R of conveyor advance. This pivot plug engages in an aperture (not shown) formed in the bracket 20 which is secured to the goaf side of the conveyor 10. The pivotal connection between the connector 19 and the bracket 20 is secured by, for example, a U-shaped coupling member 21 known per se.

The cylinder of each bracing ram 16 is pivotally connected to its associated floor girder 12 by means of a pivot 22, a connector 23 and a bracket 24. The pivot pin 22 is pivotally mounted within the connector 23 about a vertical axis, and the connector is connected to the bracket 24 in a manner to be described below. The bracket 24 is rigidly secured to the forward (face-side) end of the floor girder 12, so that the force applied by the bracing ram 16 can be transmitted to the floor girder.

Figure 2:
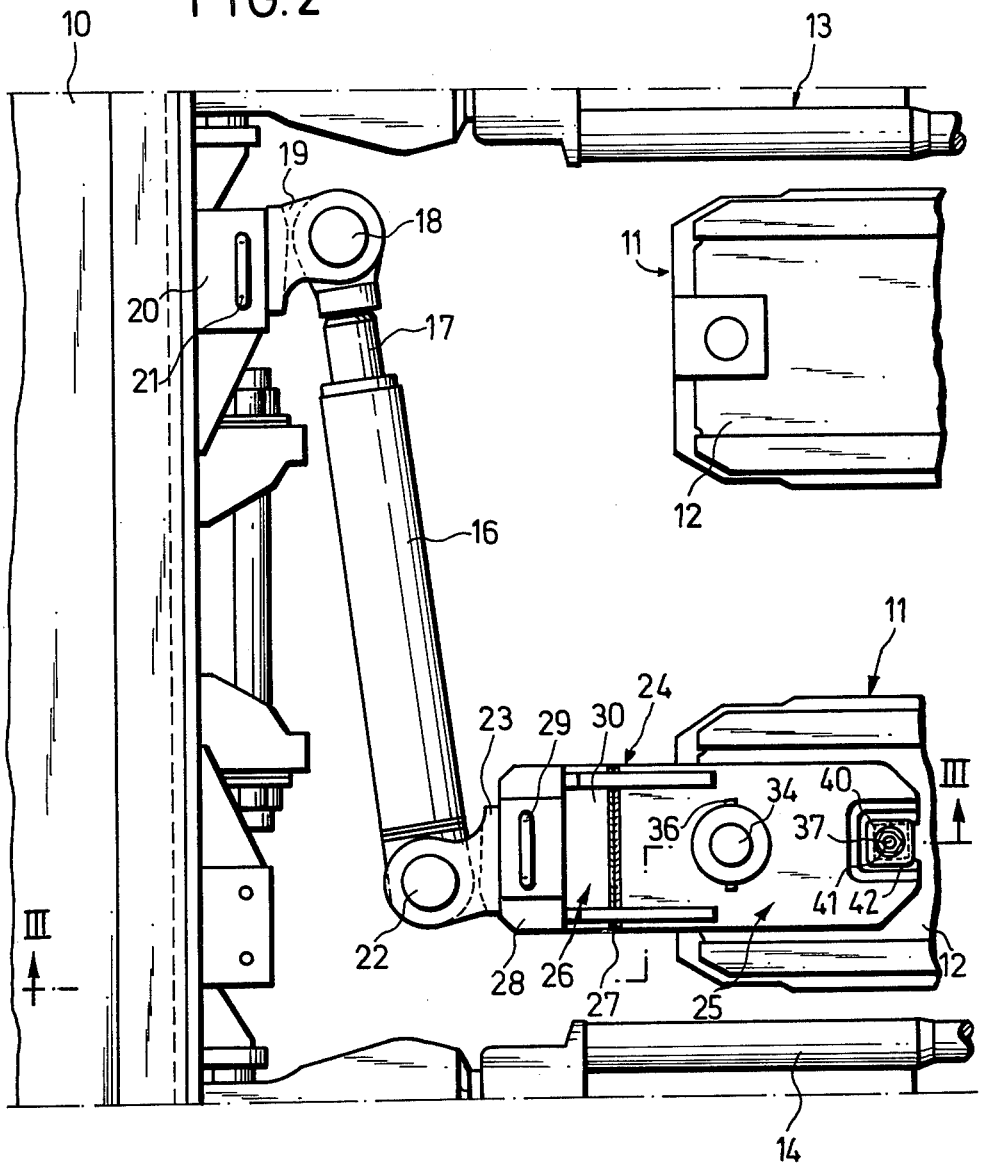
FIG. 2 is a plan view, on a enlarged scale, of part of the arrangement shown in FIG. 1.
Figure 3:
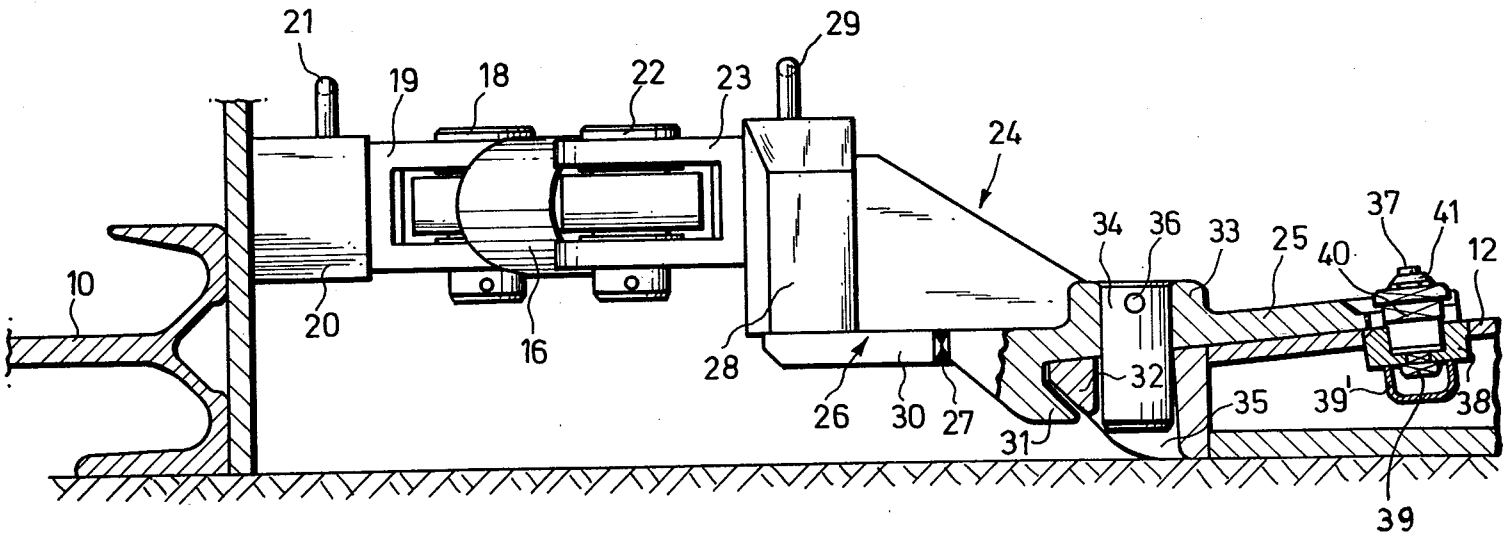
FIG. 3 is a cross-section taken on the line III—III of FIG. 2.

As best seen is FIGS. 2 and 3, the bracket 24 is of two-part construction, being constituted by a rear bracket part 25 and a front bracket part. The rear bracket part 25 is of plate-like construction which is made by casting. The rear bracket part 25 constitutes a connecting device for fixing the bracket 24 to the front end of the floor girder 12. The two bracket parts 25 and 26 are rigidly connected together by a weld seam 27. The front bracket part 26 is of composite construction, the parts of which being welded together. The front bracket part 26 has a head piece 28 which carries the connector 23. The connector 23 is similar to the connector 19, and has a pivot plug (not shown) which engages in an aperture (not shown) formed in the head piece 28, the axis of this aperture extending in the direction R of conveyor advance. The pivotal connection between the connector 23 and the head piece 28 is secured by, for example, a U-shaped coupling member 29. A plate 30 is welded to the base of the head piece 28, the rear end of the plate 30 being connected to the rear bracket 25 by means of the weld seam 27.

A downwardly-extending claw 31 is provided at the front end of the rear bracket part 25. As shown in FIG. 3, the claw 31 hooks over the tip 32 of the floor girder 12. In this way, the rear bracket part 25 is secured to the floor girder 12 at the front end thereof.

Just behind the hook 31, the rear bracket part 25 is formed with an apertured boss 33. The apertured boss 33 is aligned with an aperture 35 in the floor girder 12, and a strong pin 34 is positioned within the aligned apertures. The pin 34 is secured to the boss 33 by means of, for example, a strong dowel sleeve 36. The pin 34 thus secures the rear bracket part 25 against longitudinal and transverse movements relative to the floor girder 12.

The rear (goaf-side) end of the rear bracket part 25 is fixed to the upper face of the floor girder 12 by means of a hammer-head bolt 37. The bolt 37 fixes the rear bracket 25 to a pocket 38 which is welded into an aperture in the upper face of the floor girder 12. The pocket 38 is provided with a through bore (not shown) which has a complementary shape to the head 39 of the bolt 37. In other words, the through bore is of circular cross-section with a pair of diametrically-opposed cutouts. The bolt 37 can, therefore, be dropped into the position shown in FIG. 3 by aligning its head 39 with the bore in the pocket 38. A stop plate 39′ is provided to prevent the bolt 37 from falling right into the interior of the floor girder 12. Once the bolt 37 is positioned with its head 39 below the underneath surface of the pocket 38, the bolt is turned through 90° (thereby preventing withdrawal of the bolt), and a hollow dowel sleeve 40 is introduced into the bore of the pocket 38 from above. The sleeve 40 is provided with a square lug at its upper end, the square lug fitting within a correspondingly shaped aperture 42 formed in the top surface of the rear bracket part 25. A nut 41 is then screwed on to the upper threaded end of the bolt 37, and tightened up to fix the rear bracket part 25 to the floor girder 12.

The entire rear bracket part 25 (including the claw 31, the boss 33 and the aperture 42) is produced as a standard one-piece casting. Thus, the rear bracket part 25 is a standard item, to which front bracket parts 26 of different dimensions can be welded. In this way, the block bracing system is such that each of the hydraulic bracing rams 16 can be fitted between the conveyor 10 and a respective floor girder 12 at the same angle to the conveyor. Thus, the further a roof support unit 11 is spaced from the conveyor 10, the longer the front bracket part 26 needs to be. Consequently, the use of the brackets 24 ensures that all the hydraulic bracing rams 16 apply substantially the same bracing force to the conveyor 10.

It will be apparent that the rear bracket part 25 is such that it can be fitted to a floor girder 12 in a simple and rapid manner. Moreover, its claw 31 and bolt 37 constitute a particularly strong connection means which does not rely on expensive structural modifications to the floor girder 12. Furthermore, the attachment of the rear bracket part 25 to the floor girder 12 does not appreciably increase the vertical dimension of the latter. Where space is at a premium, the rear bracket part 25 could be arranged in a recess formed in the upper face of the floor girder 12.

We claim:

1. In a mineral mining installation including a longwall structure and a roof support unit, the roof support unit being provided with a substantially horizontal hydraulic bracing ram disposed at an acute angle to the longwall structure and acting on said structure to brace said structure longitudinally, the bracing ram being attached to a floor sill of the roof support unit by a bracket, the bracket having connection means for connecting the bracket to the floor sill and a pivot joint member for connection to the bracing ram, the improvement comprising forming the bracket by first and second bracket parts, the second bracket part being rigidly connected to the first bracket part, the first bracket part comprising said connection means and being of a plate-like construction carrying a claw at one end thereof which is engageable with a free end of the floor sill, the first bracket part having an apertured boss adjacent to the claw, there being a coupling pin which is received in the apertured boss and which is engageable in an aperture in said floor sill, and the second bracket part forming an extension of the first bracket part and carrying the pivot joint member.

2. A bracket for connecting to a hydraulic bracing ram of a block bracing system of a longwall mineral mining installation, the bracket having connection means for connecting the bracket to a floor girder of a roof support unit associated with the mineral mining installation, and a pivot joint member for connection to the bracing ram, wherein the bracket comprises first and second bracket parts, the second bracket part being rigidly connected to the first bracket part, the first bracket part comprising said connection means and being of a plate-like construction carrying a claw at one end thereof which is engageable with a free end of said floor girder, the first bracket part having an apertured boss adjacent to the claw, there being a coupling pin which is received in the apertured boss and which is engageable in an aperture in said floor girder, and the second bracket part forming an extension of the first bracket part and carrying the pivot joint member.

3. A bracket according to claim 2, wherein the first bracket part is a cast member.

4. A bracket according to claim 2, wherein the second bracket part comprises a head piece and the pivot joint member, the head piece being rigidly connected to the first bracket part.

5. A bracket according to claim 4, wherein the pivot joint member is provided with a plug which engages in an aperture formed in the head piece, and wherein a U-shaped locking member is provided for holding the plug within the aperture.

6. A bracket according to claim 2, wherein the second bracket part is welded to the first bracket part.

7. A bracket according to claim 2, wherein the first bracket part is provided with a connection device adjacent to the end remote from the claw, the connection device, the claw and the apertured boss comprising said connection means.

8. A bracket according to claim 7, wherein the connection device comprises an aperture formed in the first bracket part and bolt means for connecting the first bracket part to said floor girder.

9. A bracket according to claim 8, wherein a hammerhead bolt comprises the bolt means.

10. A bracket according to claim 2, wherein the second bracket part is welded to the claw of the first bracket part.

* * * * *